US006564740B1

(12) United States Patent
Hobdy et al.

(10) Patent No.: US 6,564,740 B1
(45) Date of Patent: May 20, 2003

(54) CHAIN TENSIONING ARRANGEMENT FOR TURRET MOORED VESSEL

(75) Inventors: Miles A. Hobdy, Houston, TX (US); Stephen P. Lindblade, Waller, TX (US); David M. Seaman, Hockley, TX (US); Michael G. Shuhatovich, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/656,436

(22) Filed: Sep. 6, 2000

Related U.S. Application Data

(60) Provisional application No. 60/153,279, filed on Sep. 9, 1999.

(51) Int. Cl.[7] ..... B63B 21/00

(52) U.S. Cl. ..... 114/230.12; 114/293

(58) Field of Search ..... 114/293, 230.1, 114/230.12, 230.13; 441/3–5

(56) References Cited

U.S. PATENT DOCUMENTS 4,305,341 A * 12/1981 Stafford ..... 114/230
4,446,807 A 5/1984 Johnson et al.
5,178,087 A * 1/1993 O'nion et al. ..... 114/230
5,842,434 A * 12/1998 Lange et al. ..... 114/230

OTHER PUBLICATIONS

Drawings for 1997 Internal Turret Mooring System.

* cited by examiner

*Primary Examiner*—S. Joseph Morano
*Assistant Examiner*—Ajay Vasudeva
(74) *Attorney, Agent, or Firm*—Gary L. Bush, Esq.; Andrews & Kurth, LLP

(57) ABSTRACT

A single hoisting mechanism is positioned on a turret of either an external or an internal turret mooring system for a FSO or FPSO vessel and is releasably securable to each of a plurality of anchor leg chains. The mechanism is mounted for angular rotation about the center-line of the turret in order that the hoist can be angularly aligned and selectively engaged with each of the anchor leg chains or riser/umbilicals spaced around the turret.

7 Claims, 4 Drawing Sheets

126
120
119
122
107
124
114
118
106
100
113
111
111
130
101
110
110
112
132
116
102
112

CHAIN TENSIONING ARRANGEMENT FOR TURRET MOORED VESSEL

CROSS REFERENCE TO PROVISIONAL APPLICATION

This application claims priority from U.S. Provisional Application Ser. No. 60/153,279 filed on Sep. 9, 1999.

BACKGROUND OF THE INVENTION

1. Field of this Invention

This invention relates to chain tensioning arrangements for use during anchor leg tensioning of a turret moored vessel.

2. Description of the Prior Art

FIG. 1 shows a typical prior art permanently connected turret mooring system in a partial cross-section through the internal turret section of the vessel. Such system includes a vessel V having a well W in which a lower turret 10 is rotatably supported with respect to vessel V at deck D by means of bearings 12. An upper turret 14 is secured to lower turret 10. A plurality of anchor legs 16, (formed at least partially with chains) are secured to the turret in order to substantially secure the lower turret 10 and upper turret 14 to the sea floor. The anchor legs 16 run through chain tubes 18 and via sheave 20 and winch/windlass 22 to a chain locker 24 all located on the upper turret 14. A separate windlass 22 and sheave 20 is provided for each anchor leg. Such windlass/sheave assemblies are arranged about the upper turret 14.

Other prior art arrangements have provided a simple winch on the deck of the vessel where the vessel must be rotated with respect to the turret and to a particular anchor chain for tensioning such a chain. Rotation of the vessel requires either a dynamic positioning system or tugboats to orient the vessel against waves, currents and wind or a hydraulic motor and bull gear arrangement for rotating the vessel with respect to the turret. In such arrangements large sheave assembles must be placed at different angular positions on the turret to align with the chain tube and the winch for different angular orientations of the winch with respect to the turret. Large diameter wire rope is required for retrieving anchor leg chains and fluid risers. The possibility of a wire rope breaking poses a great risk to personnel working on the vessel deck where the wire rope passes through several sheave assemblies.

The prior art's placement of an anchor chain winch on the vessel deck requires that a the vessel deck structure be stiffened to accept the large loads of the winch itself and the forces required to tension an anchor leg. Such stiffening requires increased costs associated with increased steel and vessel design work.

The winch on the deck of such prior art arrangements is usually placed several meters from the turret center-line in order to accommodate proper wire rope spooling. Such placement puts the winch operator at a disadvantage during anchor chain tensioning because of the equipment noise and distance between the winch operator and workmen within the turret.

3. Identification of Objects of this Invention

A primary object of this invention is to provide a chain tensioning arrangement for a turret mooring system that reduces the weight and cost of vessel structures associated with the turret mooring.

Another object of the invention is to provide a chain tensioning system which reduces installation time for tensioning an anchor chain of a turret mooring system.

Another object of the invention is to provide a winch and turret arrangement which reduces hazards to personnel during chain tensioning of a permanently connected turret mooring system;

Another object of the invention is to provide a winch and turret arrangement which reduces the number of support vessels required to tension anchor chains of the turret mooring system.

SUMMARY OF THE INVENTION

The objects identified above along with other features and advantages are incorporated in a chain tensioning system for a turret mooring system in which only a single winch is placed on the turret at its center-line and is rotatable with respect to the turret so as to angularly align it with anchor chains spread about the circumference of the turret. Anchor leg tensioning operations can be conducted without regard to vessel heading by rotating the winch with respect to the turret until it is aligned with an anchor chain that is to be tensioned. The invention can be used with external or internal turret mooring systems. A flapper style/ratcheting chain support is provided on the turret for each anchor chain so that mooring leg retrieval operations can continuously be conducted until the desired chain tension is achieved.

BRIEF DESCRIPTION OF THE DRAWINGS

The objects, advantages and features of the invention will become more apparent by reference to the drawings which are appended hereto and wherein an illustrative embodiment of the invention is shown, of which.

DESCRIPTION OF THE INVENTION

Figure 2:
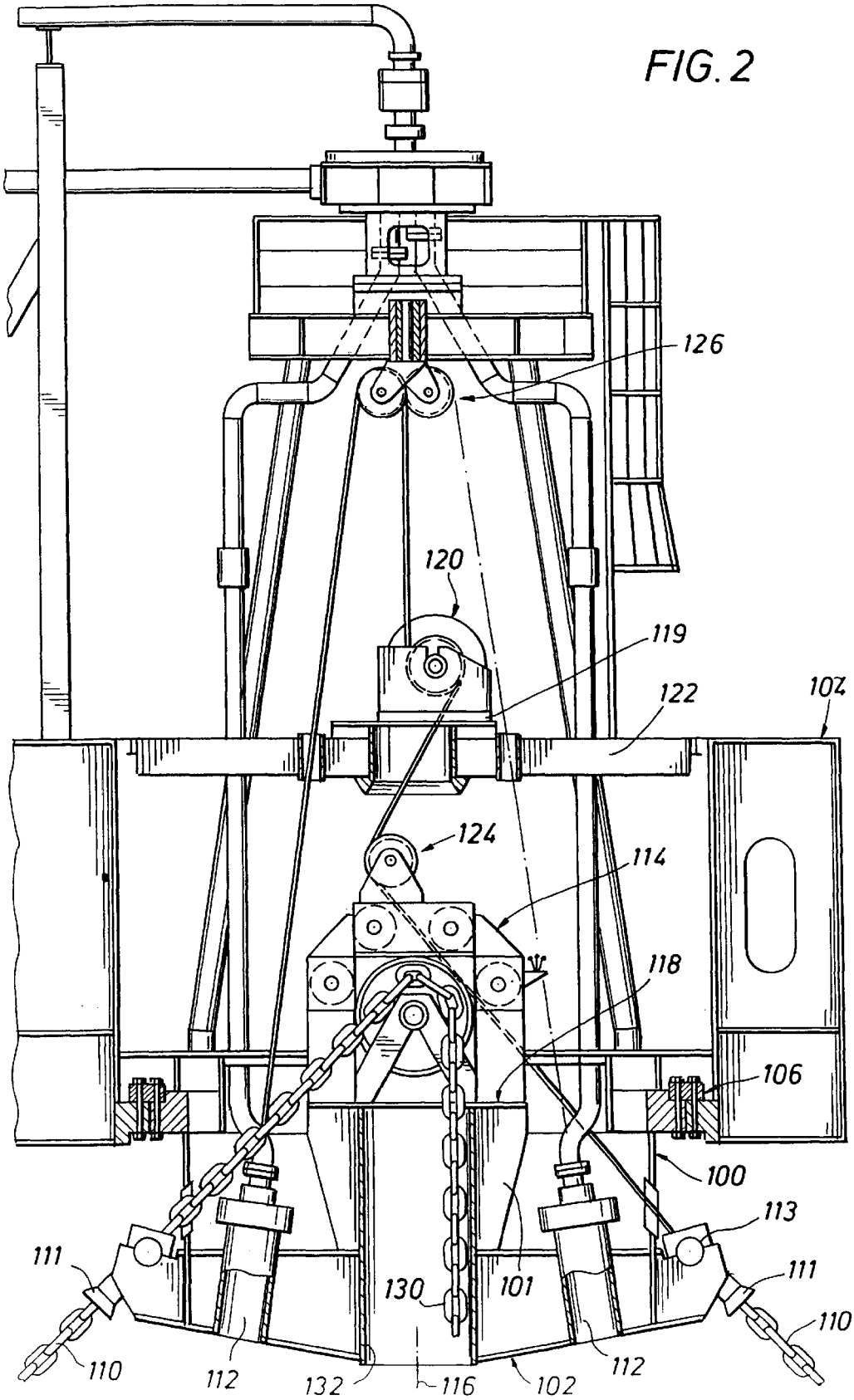
FIG. 2 is a side cross-sectional view of an external turret embodiment of the invention with a chain tensioning device placed on or about the center-line of the turret, where the tensioning device is rotatable about the turret center-line so as to be selectively aligned with any one of the chain legs during tensioning operations.

The mooring arrangement of FIG. 2 shows a turret 100 and chain table 102 rotatably supported on an external frame 104, (called a turret head) by means of a turret bearing assembly 106. The frame 104 may be supported from the bow of a Floating Storage and Offloading FSO or Floating Production, Storage and Offloading FPSO vessel for example FIG. 2 illustrates lower and upper turrets, riser tubes and a product swivel to support transfer of hydrocarbon product to storage holds on the vessel. A chain table 102 permanently fixed to the bottom of the lower turret 100. Anchor chain mooring legs 110 and riser tubes 112 are carried by the chain table 102.

A winch/windlass assembly 114 for tensioning anchor legs 110 is positioned and rotatably supported on the turret so that it can be rotated with respect to the turret vertical central axis 116. The rotatable mounting of assembly 114 is with respect to internal turret ring 101. A plate 118 is supported by a bearing assembly on turret ring 101 for rotatable mounting of the winch/windlass assembly 114 with respect to the turret 100. As a result of this arrangement the chain winding spool of assembly 114 can be substantially aligned with each of the chain legs 110 of the anchor leg 110 array. An auxiliary winch/windlass assembly 120 is also rotatably supported (e.g., by plate 119 supported on bearings with respect to upper turret deck 122) with respect to turret 100 so that it can be rotated and thereby aligned with anchor chain conductors 111 and riser tubes 112. The sheave assemblies 124 and 126 can also be rotated so that pull in leads can be angularly aligned with auxiliary winch/windlass 120.

FIG. 2 illustrates that during chain tensioning operations, excess anchor chain 130 may extend into a turret center well 132. Such excess chain is removed after a leg is tensioned at a desired level. Chain of anchor legs 110 enter chain table 102 via hawse pipe 100. A flapper style/ratcheting chain support 113 is provided so that mooring leg retrieval operation can be conducted continuously until desired chain tension is achieved.

Figure 3:
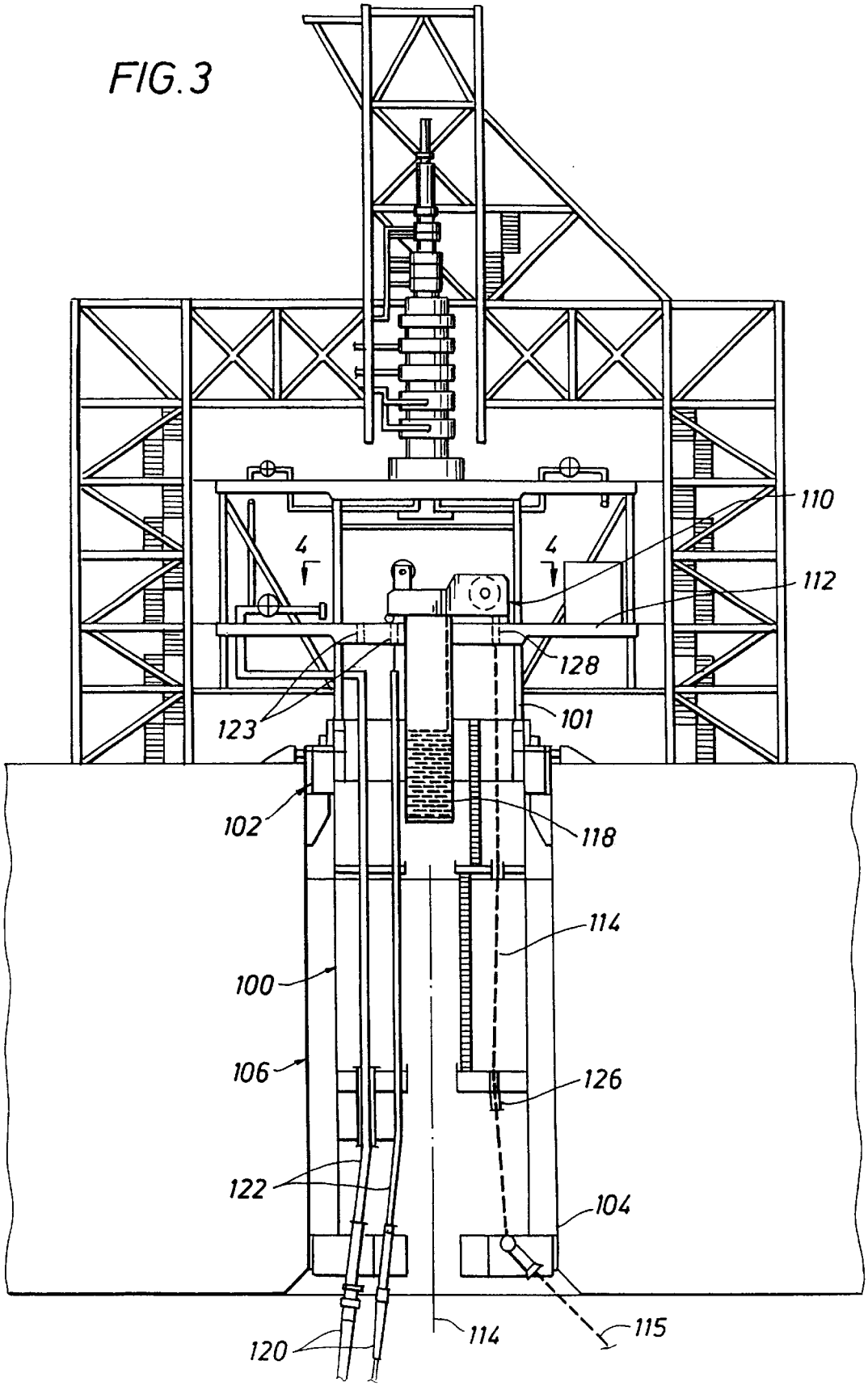
FIG. 3 is a side cross-sectional view of an internal turret embodiment of the invention with a rotatably movable powered windlass for tensioning anchor leg chains and pulling in risers.

FIG. 3 is a cross-section of a portion of a FPSO or FSO vessel having an internal turret 100 rotatably supported by an upper bearing assembly 102 and lower bearing assemble 104 within a moonpool bulkhead 106. A rotatable powered windlass with hoist assembly 110 is mounted at pull-in deck 112 for rotation about turret center-line 114. The pull-in deck is mounted on an upper turret 101 which is secured to lower turret 100. The rotatability of assembly 110 enables it to be angularly aligned with the pull-in chains coupled to anchor legs 115 via guides 126, 128. Excess chain is stored in chain locker 118 during tensioning operations. Flexible risers and umbilicals can also be pulled in by means of the powered windlass and hoist assembly 110 after angular alignment with riser and umbilical guides 122, 123.

Figure 4:
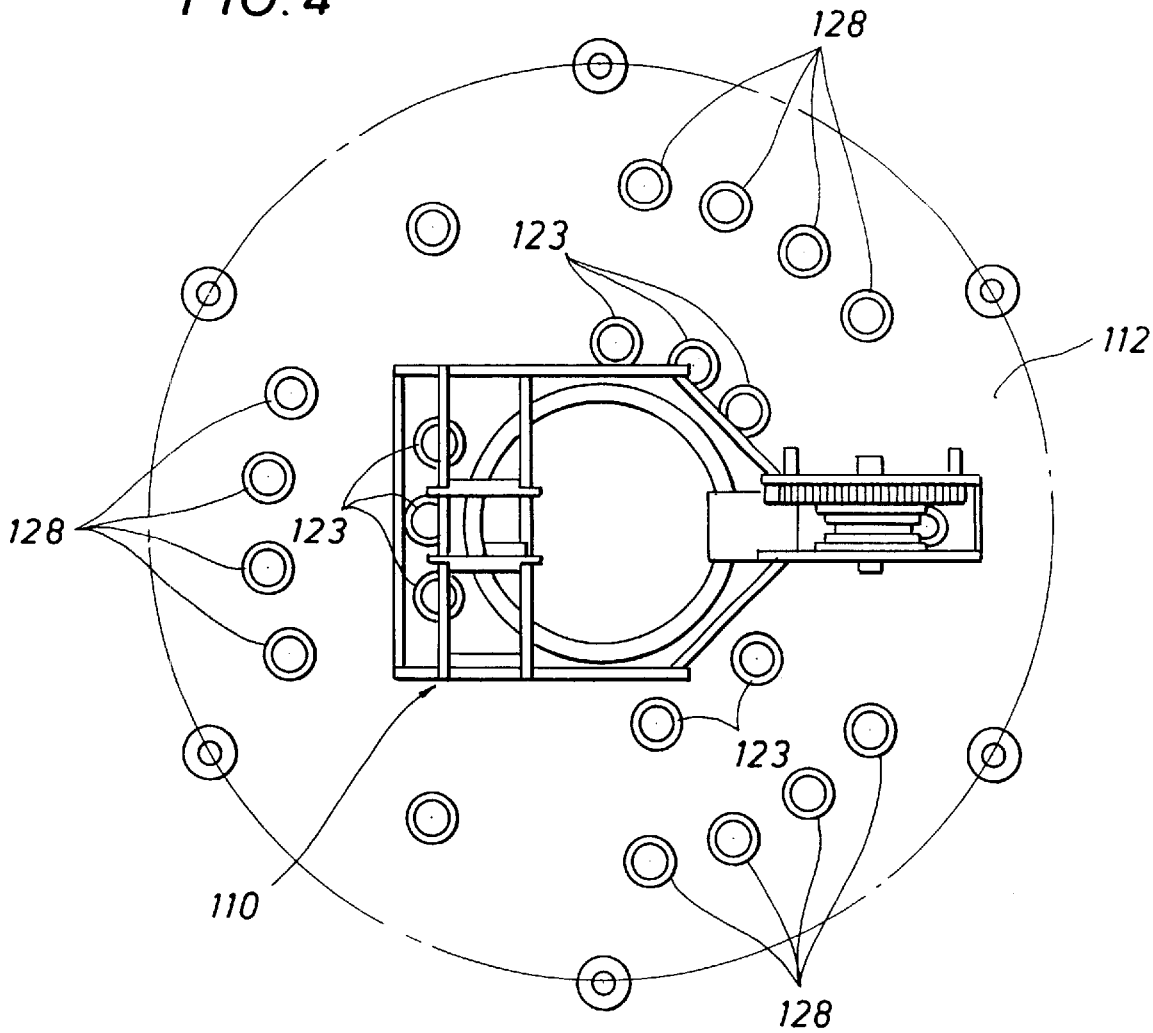
FIG. 4 is a downward plan view along lines 4—4 of FIG. 3.

FIG. 4 is a section view taken along lines 4—4 of FIG. 3 which further illustrate the rotatable powered windlass/hoist assembly 110 and anchor chains conductor guides 128 and riser/umbilical guides 123 spaced angularly about deck 112.

The invention of the chain tensioning arrangement in FIGS. 2, 3, and 4 result in several important advantages over prior art arrangements.

Figure 1:
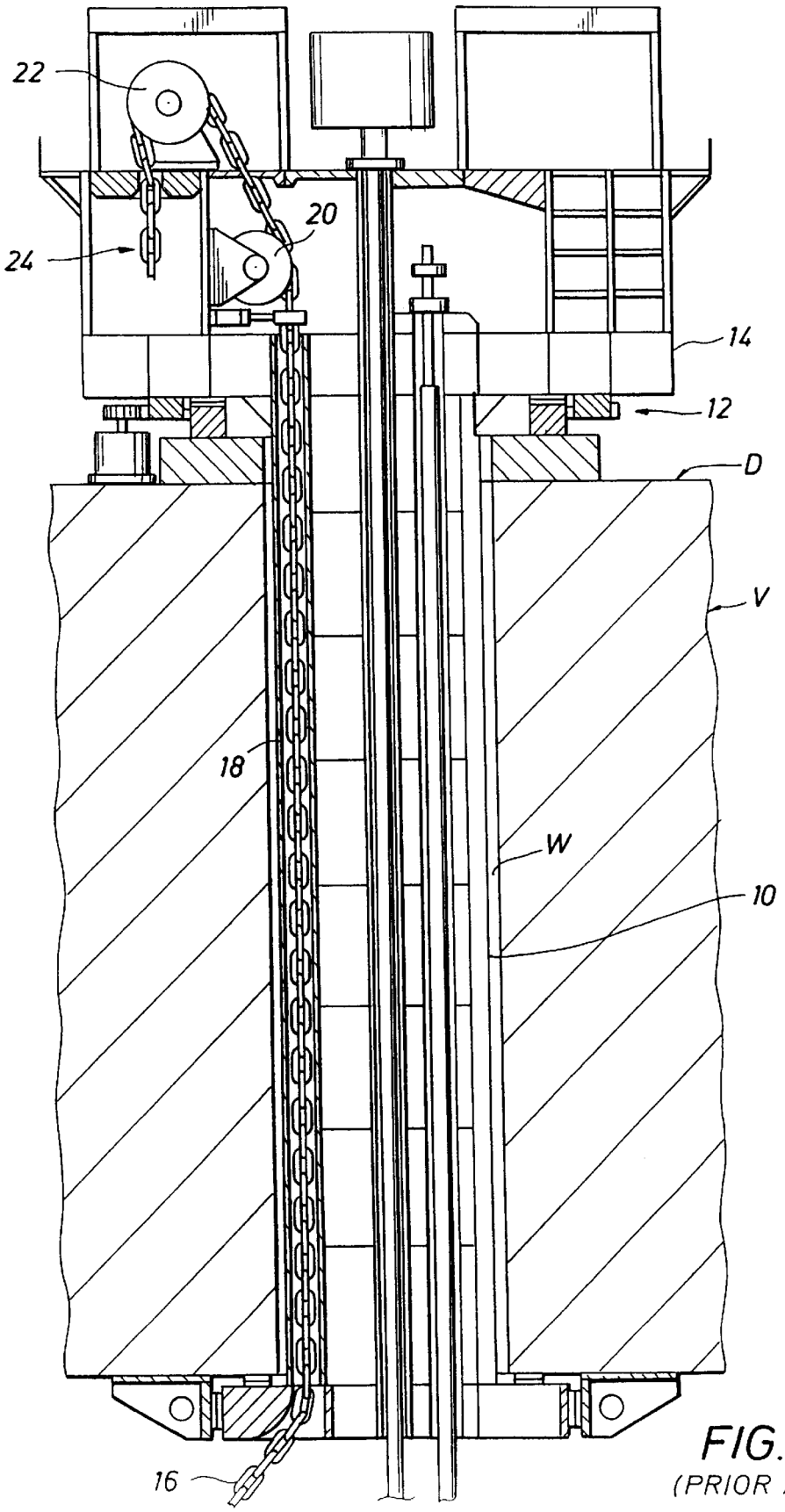
FIG. 1 (PRIOR ART)
FIG. 1 is an illustration of a prior art permanently connected turret mooring system where multiple winches are provided on the turret, with one winch provided for each anchor chain installed.

First, by providing a rotatable hoist/windlass assembly on the turret itself, the requirement of providing multiple hoists on the turret as in the FIG. 1 prior art arrangement is avoided, and the requirement for tug boat assistance to prohibit vessel rotation during anchor leg installation is eliminated where the hoist is placed on the vessel deck.

Second, the overall geometry of the turret and chain table, for example in the embodiment of FIG. 2, is arranged to reduce size, weight and eccentric loading on the chain supports and provides easier, more efficient, anchor chain tensioning operations.

Third, because all equipment relating to anchor leg and riser installation is disposed on the turret, safety to facility personnel is improved as compared to arrangements where the winch is placed on the deck of the vessel.

What is claimed is:

1. In an arrangement for mooring an offshore vessel to the seabed including a turret rotatably coupled to the vessel, and anchor legs extending from the seabed to the turret in order to substantially fix the turret to said seabed, an improvement wherein only a single hoisting mechanism is rotationally supported on said turret and which is releasably securable to each of a plurality of anchor legs for tensioning each of said anchor legs to a portion of said turret, and said anchor legs are angularly spaced about a center-line of said turret, and said hoisting mechanism is capable of rotation on said turret about said center line for selective angular alignment with each of said anchor legs.

2. The arrangement of claim 1 wherein, said turret is internally mounted with respect to a moonpool bulkhead formed in said vessel.

3. The arrangement of claim 1 wherein, said turret is externally mounted with respect to a turret head mounted on said vessel.

4. In an arrangement for mooring an offshore vessel to the seabed including a turret rotatably coupled to the vessel, wherein anchor legs extend from the seabed to the turret in order to substantially fix the turret to said seabed, and wherein said turret includes an upper turret and a lower turret, an improvement comprising only a single hoisting mechanism is mounted on said lower turret, wherein said single hoisting mechanism is releasably securable to each of a plurality of anchor legs for tensioning each of said anchor legs to a portion of said turret.

5. The arrangement of claim 4, wherein said anchor legs are angularly spaced about a center-line of said turret, and said hoisting mechanism is rotatably mounted on said center-line of said turret for selective angular alignment with each of said anchor legs.

6. The arrangement of claim 4, wherein said turret is externally mounted with respect to a turret head mounted on said vessel.

7. The arrangement of claim 4, wherein said turret is internally mounted with respect to a moonpool bulkhead formed in said vessel.

* * * * *